United States Patent [19]

Pownall et al.

[11] 4,441,880

[45] Apr. 10, 1984

[54] DRYING APPARATUS

[75] Inventors: Colin S. Pownall, Southwell; Joseph L. Spencer, West Bridgford, both of England

[73] Assignee: Pownall Spencer Engineering, Ltd., Southwell, United Kingdom

[21] Appl. No.: 366,001

[22] Filed: Apr. 6, 1982

[30] Foreign Application Priority Data

Apr. 23, 1981 [GB] United Kingdom ..... 8112650

[51] Int. Cl.[3] ..... F27B 14/00; F26B 9/18; F26B 11/00; F23B 5/00

[52] U.S. Cl. ..... 432/13; 34/187; 34/237; 110/203; 110/211; 432/139; 432/186

[58] Field of Search ..... 432/13, 139, 143, 186; 110/203, 204, 211, 214; 34/184, 185, 187, 237

[56] References Cited

U.S. PATENT DOCUMENTS

| | | | |
|---|---|---|---|
| 44,906 | 11/1864 | Wilson . | |
| 514,553 | 2/1894 | Jones et al. . | |
| 791,600 | 6/1905 | Anderson et al. . | |
| 816,379 | 3/1906 | Rommel | 34/185 |
| 1,061,941 | 5/1913 | Hoffmann . | |
| 1,330,219 | 2/1920 | Rockwell . | |
| 1,331,240 | 2/1920 | Connelley | 110/204 |
| 1,599,467 | 9/1926 | Graves | 432/139 |
| 1,639,243 | 8/1927 | Weintz . | |
| 1,774,860 | 9/1930 | Wendler et al. | 34/237 |
| 1,999,513 | 4/1935 | Morrison | 34/24 |
| 2,267,259 | 12/1941 | Adt | 257/92 |
| 2,710,182 | 6/1955 | Sheldon | 432/139 |
| 3,180,630 | 4/1965 | Endres et al. | 432/13 |
| 3,306,237 | 2/1967 | Ransom, Jr. | 110/14 |
| 3,604,824 | 9/1971 | Hardison | 431/116 |
| 3,627,290 | 12/1971 | Grieve | 263/40 |
| 3,794,459 | 2/1974 | Meenan | 431/5 |
| 3,836,324 | 9/1974 | Shaefer et al. | 432/112 |
| 3,963,416 | 6/1976 | Mach | 432/64 |
| 4,054,418 | 10/1977 | Miller et al. | 110/203 |
| 4,191,527 | 3/1980 | Trouillard | 432/72 |
| 4,230,451 | 10/1980 | Chambe | 432/72 |
| 4,324,545 | 4/1982 | Hubbert | 432/182 |

FOREIGN PATENT DOCUMENTS

| | | |
|---|---|---|
| 15357 | 3/1979 | European Pat. Off. . |
| 1564004 | 12/1925 | United Kingdom . |
| 1345152 | 5/1970 | United Kingdom . |

*Primary Examiner*—John J. Camby
*Attorney, Agent, or Firm*—Kilpatrick & Cody

[57] ABSTRACT

An apparatus and method for drying organic and other waste materials such as industrial by products, agricultural and animal wastes, blood and manure. A round, flat bottom substantially closed pan with a double-wall bottom and side forming a jacket and having a paddle-type agitator receives the material to be dried. Heat is provided by a gas-fired incinerator which preheats air that is admitted to the pan and then drawn into and combusted in the incinerator together with gases and moisture evolved from the material being dried. The incinerator's combustion products are passed through the pan jacket to heat the material being dried and are then vented through a chimney.

10 Claims, 6 Drawing Figures

DRYING APPARATUS

BACKGROUND OF THE INVENTION

This invention relates to drying apparatus especially for use in drying and sterilizing industrial by products and organic materials of any moisture content, such as agricultural and animal wastes, blood, manure and the like, e.g. for use in animal foods or fertilizers.

Various waste dehydrator structures are known in the prior art, such as the United States patents to Chambe, No. 4,230,451, Trouillard, No. 4,191,527 and Hoffman No. 1,061,941, but such structures are believed to achieve lower efficiency levels than the extremely efficient operation attainable with the present invention, and such prior art structures do not secure other advantages of the present invention.

Problems associated with prior art drying apparatus include high fuel and energy costs associated with inefficient operation; problems in accommodating materials with nonuniform initial moisture content and in processing to a uniform final moisture content; the need to control release of gases evolved from the material being dried; and the large size of and consequent space requirements for prior art apparatus which is frequently difficult to transport, assemble and place in operation, particularly in remote locations. These and other problems associated with the prior art dehydrators are solved by the present invention.

SUMMARY OF THE INVENTION

The present invention provides drying apparatus comprising a round, flat bottom pan for containing material to be dried and a means for burning gases given off by the drying material and passing the resulting hot gases adjacent the pan for heating the material therein. The arrangement allows efficient use of the heat applied to the drying process with removal of noxious gases before venting to atmosphere.

Preferably the pan has a double skin base or bottom with a space therebetween through which the gases are passed. The space may also communicate with a duct around the pan, and the double-skin arrangement is preferably by spacing members. The means for burning cases given off by the drying material and supplying heat to the pan may be a natural gas or other fossil fuel fired incinerator.

Extraction means is preferably provided for drawing gases from the pan and feeding them to the burning means and an air inlet is provided to the pan. A labyrinth structure surrounding the incinerator burner and through which the gases drawn from the pan are admitted to the incinerator contribute to efficient and complete combustion of such gases.

Advantageously, air passed to the pan air inlet is pre-heated, channels for the air being provided adjacent the burning means, typlically in a manifold surrounding the incinerator combustion chamber. Such preheating of the inlet air facilitates drying of the material, and enables the air to absorb more moisture from the material and extract more gases, such as methane and ammonia, evolved from the material. The apparatus of the present invention will readily dry a mass of organic waste material to a predetermined moisture content which is uniform throughout the mass with extremely fuel efficient operation.

DETAILED DESCRIPTION OF THE DRAWINGS

Figure 1:
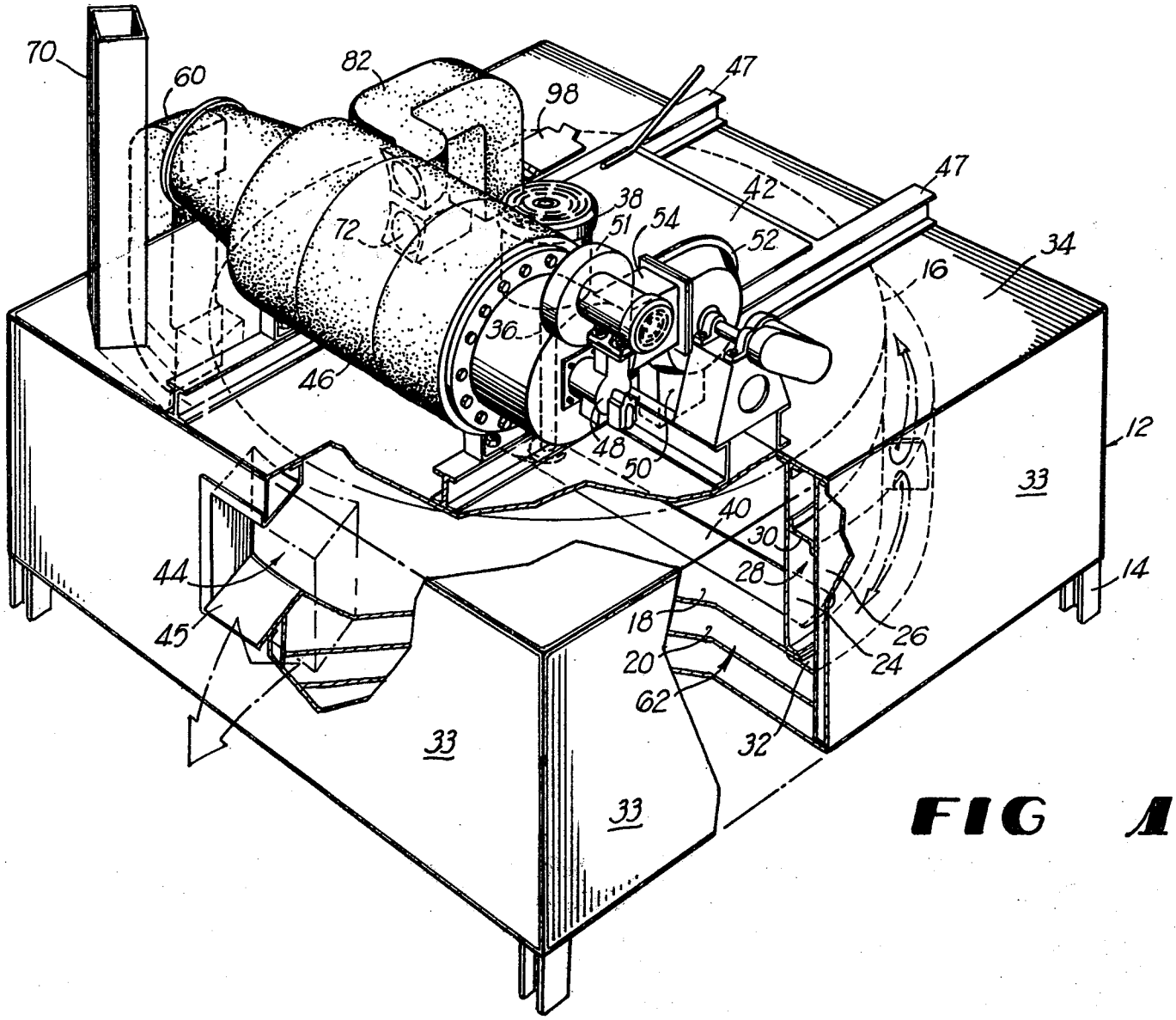
FIG. 1 is a perspective view of the drying apparatus of the present invention.
Figure 3:
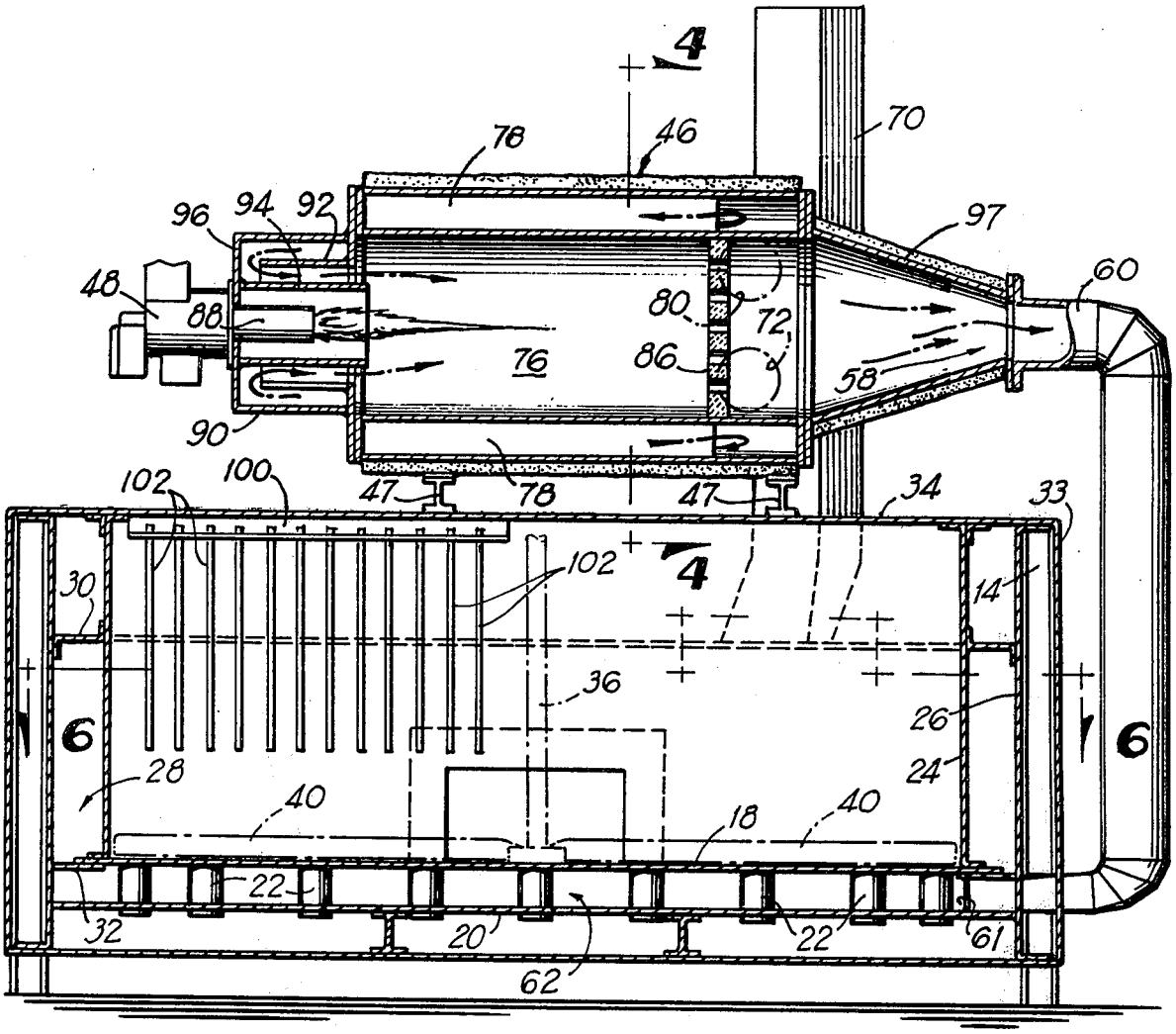
FIG. 3 is a front elevational view, in section, of the present invention showing the internal structure of the incinerator and pan.
Figure 6:
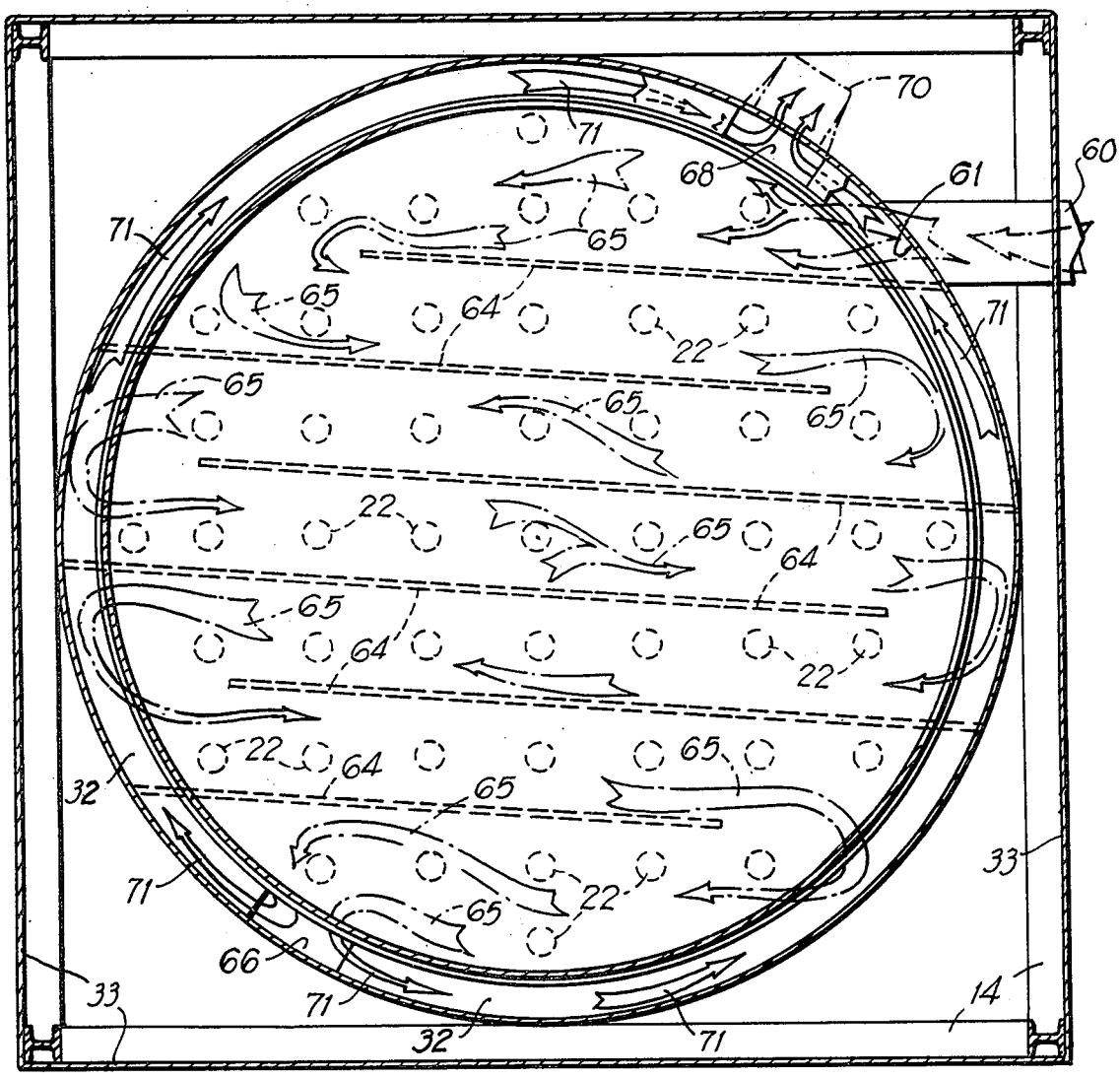
FIG. 6 is a top plan view taken along Line 6—6 in FIG. 4 with the position of the incinerator shown in broken lines.

Referring to FIG. 1, the drying apparatus 12 comprises generally a support frame 14 which supports a cylindrical drying pan 16. The base of the pan 16 is of double skinned construction comprising an inner base or bottom 18 and a lower or outer bottom 20 separated by supporting and reinforcing members in the form of vertical rods or tubes 22, which may be seen in FIGS. 3 and 6. The pan 16 also includes a partly double skin cylindrical side having an inner cylindrical wall 24 which terminates at the inner pan bottom 18 and an outer cylindrical wall 26 which extends from the outer bottom 20 to a position part way up inner wall 24 (typically approximately two-thirds of the way up wall 24) to define a duct 28 having a duct bottom 32 formed by inner bottom 18 and a duct top 30. The double bottom construction and duct 28 together form a jacket substantially surrounding the waste material supporting and containing portion of pan 16 to permit efficient transfer of heat to that material as it is being dried as described in more detail below. Frame 14 is covered by steel plate sides 33, and rock wool or other appropriate insulation (not shown) fills the spaces between sides 33 and pan 16 to reduce heat loss from pan 16.

The frame 14 also supports a cover for the pan 16 which is the top 34 of the drying apparatus 12. Extending through the center of top 34 is a rotatably mounted vertical shaft 36. Shaft 36 is connected to an electric motor and geared speed reducing means 38. Within the pan 16, near its bottom, agitator paddles 40 having rigid steel scaper blades are connected to the shaft 36 so that waste material to be dried in the drying apparatus 12 can be agitated by such paddles 40 powered by the geared motor 38. A trap door 42 in the top 34 may be opened to load waste material into the drying pan 16, and dried material may be removed through a chute 44 located in the side of the drying pan 16 at any convenient position and closed by a hinged chute door 45.

Supported on steel I-beams 47 on the top 34 is an incinerator 46 having a burner 48 at one end. Burner 48 has a burner fan 51 and may be a natural gas or other fossil fuel burner, and it should typically have a capacity of at least one million BTU's per hour. A pan outlet opening 50 in top 34 communicates with an extractor fan 52 shown in FIGS. 1 and 2 for extracting gases from the pan. A conduit 54, also shown in FIGS. 1 and 2, leads from the extractor fan 52 to the incinerator 46, where the gases pass through a swirl or labyrinth 56 (further described below) before such gases enter the combustion chamber 76 of the incinerator 46. An incinerator outlet 58 (visible in FIG. 2) leads through an outlet conduit 60, which communicates with the space 62 between the inner pan bottom 18 and outer bottom 20, as will be appreciated by reference to FIGS. 3 and 6, by connecting to jacket inlet opening 61. Staggered baffles 64, comprising vertical plates which extend between the inner bottom 18 and outer bottom 20, are positioned along parallel chords of the circular pan 16 bottom to force gases to flow back and forth, as indicated by flow arrows 65, between the pan bottom 18 and outer bottom 20 as such gases traverse from inlet opening 61 to duct opening 66 opposite that position, as will be appreciated by reference to FIG. 6. Space 62 communicates with duct 28 through duct opening 66, thereby permitting gases to flow from space 62 into duct 28 and through duct 28 in both directions around drying pan 16 to duct outlet 68 which connects with chimney 70, as indicated by flow arrows 71.

Figure 4:
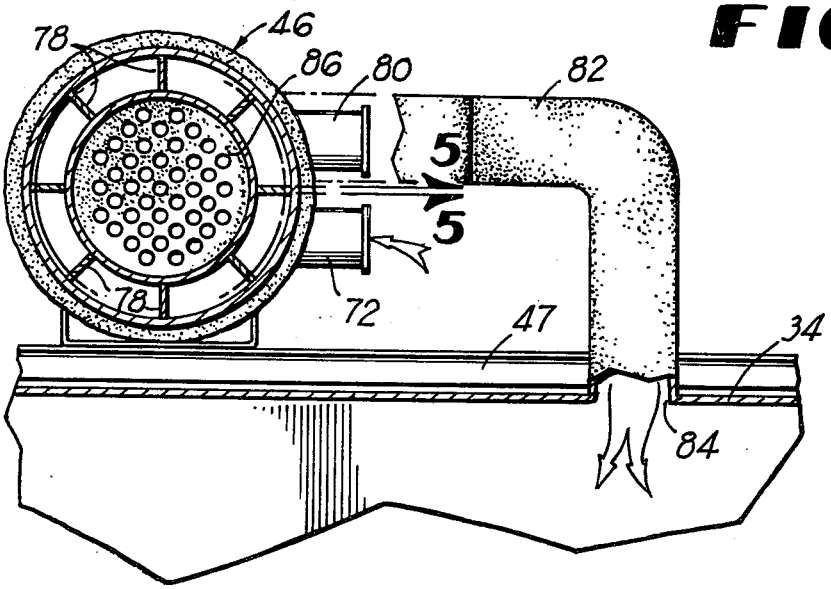
FIG. 4 is a side elevational detail view of the incinerator portion of the present invention taken along Line 4—4 in FIG. 3.
Figure 5:
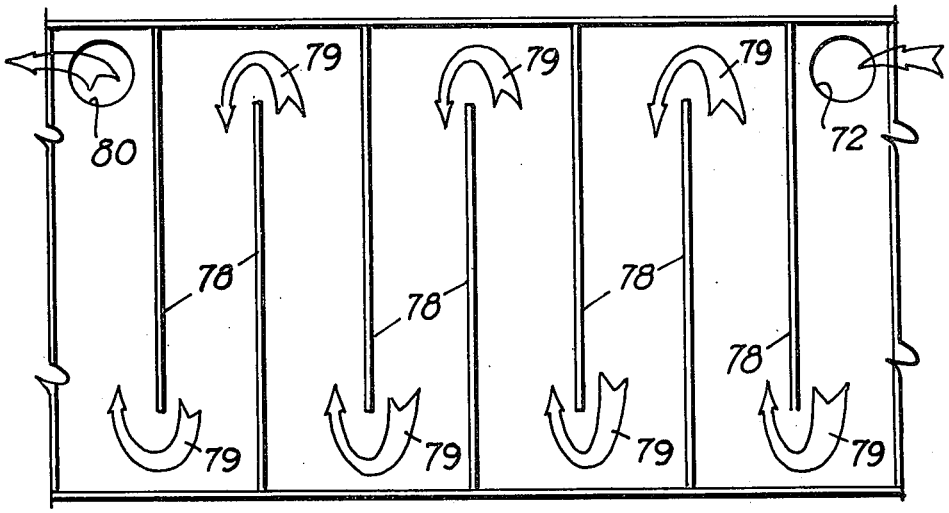
FIG. 5 is a "roll-out" view of the incinerator taken along Line 5—5 in FIG. 4 to show the baffle structure in the incinerator manifold.

Outside air is drawn into air inlet 72 (shown in FIG. 2) in the side of incinerator 46, where it passes into a manifold 74 surrounding the combustion chamber 76 of the incinerator 46. Manifold 74 forms a jacket around combustion chamber 76 and is divided by manifold baffles 78, comprising staggered plates oriented lengthwise of incinerator 46 with alternate open ends. As will be appreciated by reference to FIG. 5, baffles 78 create a back and forth path indicated by flow arrows 79 for air to pass through the manifold and around incinerator 46, where it is preheated by its proximity to combustion chamber 76 before leaving manifold 74 through manifold outlet 80. Outlet 80 communicates through an outlet conduit 82, visible in FIGS. 1, 2 and 4, with an inlet port 84 (shown in FIG. 4) in top 34 to permit the flow of pre-heated air into the drying pan 16. Inlet port 84 is located across drying pan 16 from outlet opening 50 and extractor fan 52, thereby insuring that the hot air will flow across the material being dried and will mix with moisture and other gases evolved from the material before the mixture of air and gases is drawn into incinerator 46 through extractor fan 52.

Figure 2:
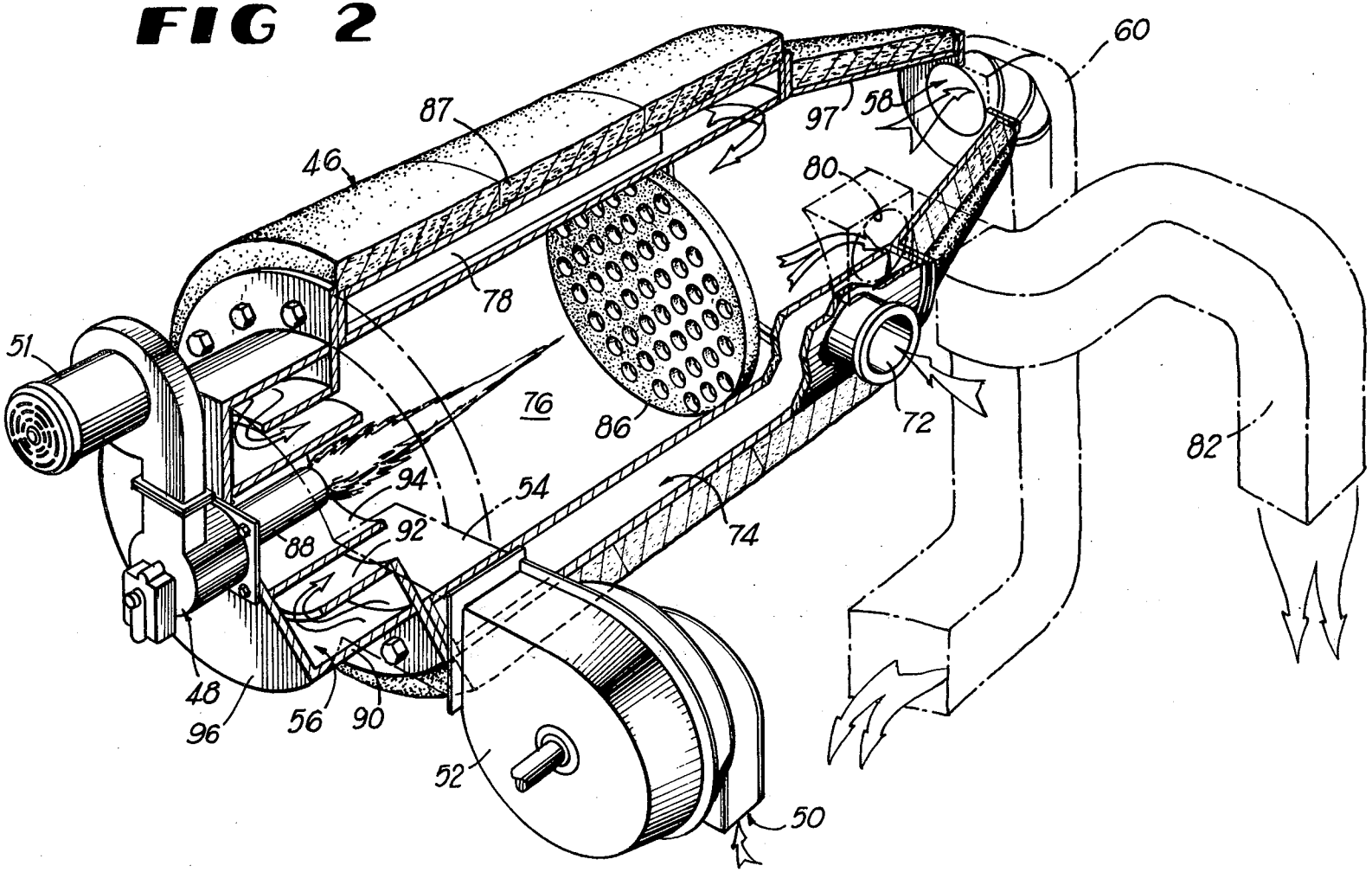
FIG. 2 is a perspective view of the incinerator portion of the present invention shown in FIG. 1 with a longitudinal segment of the incinerator cut away to show its internal structure.

As is illustrated in detail in FIG. 2, the incinerator 46 comprises generally a cylindrical combustion chamber 76 which is constructed of refractory lined mild steel forming a tube and contains a perforated refractory plate 86 normal to the axis of the tube. Combustion chamber 76 is surrounded by manifold 74 described above, and the outside of the incinerator is surrounded by a blanket of rock wool or other appropriate insulation 87 which reduces heat loss from the incinerator 46, thereby promoting efficiency. Gases from the material being dried and air drawn by extractor fan 52 pass through the labyrinth structure 56 surrounding burner nozzle 88 by passing into a space formed by the outer cylindrical wall 90 of incinerator 48 and a tube 92 coaxially disposed within such outer wall 90, closed on the combustion chamber 76 side and open away from combustion chamber 76 such that a passage is formed between the tube 92 and end wall 96 of incinerator 46. A second tube 94 coaxially disposed within the first tube 92 surrounds incinerator nozzle 88, is mounted against the incinerator 46 end wall 96 and is open to combustion chamber 76. Thus, gases drawn by extractor fan 52 from the drying pan 16 swirl back and forth and around incinerator nozzle 88 before entering combustion chamber 76 where they thoroughly mix with other gases in such chamber and contribute to and support combustion therein. Such swirling motion in the labrynith structure 56 insures thorough mixing of the air and gases drawn from pan 16 and preheats the mixture by passage proximite burner nozzle 88 before entering combustion chamber 76, thereby contributing to combustion efficiency. Refractory plate 86 delays passage of the gases out of combustion chamber 76 and contributes to assurance that substantially complete combustion of the combustible gases will occur. Combustion chamber 76 communicates with outlet conduit 60 at the opposite end of incinerator 46 from burner nozzle 88 through a frusto-conical section 97 which tapers from the diameter of combustion chamber 76 to that of conduit 60.

In operation, industrial by-products or organic agricultural, animal or other waste to be processed in the drying apparatus 12, such as manure, is fed into the drying pan 16 through trap door 42, either manually or by utilization of a mechanical conveyor or other loading apparatus (not shown), and the material to be processed is agitated by agitator paddles 40.

The incinerator 46 and the extractor fan 52 are also operated, and the hot gases of combustion pass from combustion chamber 76 through outlet conduit 60 to the space 62 between the inner pan bottom 18 and outer pan bottom 20, from there to duct 28, around pan 16 and are then vented to the atmosphere through the chimney 70. The hot gases heat the material in pan 16 so that water vapor is produced and mixed with gases produced by decay. These gases and vapor are drawn off from pan 16 by extractor fan 52 and are fed into the labyrinth 56 and hence into the combustion chamber 76. The gases are burnt in the chamber and form part of the gases of combustion passing through outlet conduit 60. Heat from the hot gases and the energy in the combustible gases leaving the pan 16 is therefore not lost, but is reused in heating the pan 16, thereby contributing to increased efficiency.

Fresh air is drawn into inlet 72 by operation of the extractor fan 54 and passes through the manifold 74 to be preheated and then through outlet conduit 82 to the interior of the pan. The vapor and gases given off by the manure or other material being dried are, therefore, mixed with hot fresh air, which assists in combustion in the chamber 76, and such preheated air is able to absorb and carry out of pan 16 significantly more water vapor than would ambient temperature air, therefore significantly contributing to overall efficiency and speeding drying.

The geared motor 38 may be a variable speed unit if desired. It has been determined that rotation of agitator paddles 40 at eight (8) revolutions per minute permits transfer of heat from pan 16 inner bottom 18 without burning and sticking of the waste material being dried. Agitation also facilitates moisture release from the material, and other agitation speeds may achieve optimum drying with specific waste materials. The agitator paddles 40 also accomplish discharge of dried material from the apparatus by sweeping such material out chute 44 when chute door 45 is opened. Rotation of agitator paddles at a higher speed, such as twenty-five (25) revolutions per minute, will speed such discharge.

Foaming of the material being dried may occur, and to prevent spillage from the pan and consequent damage to the apparatus, means is provided to facilitate cooling when desired to reduce such foaming. The burner 48 may be switched off, and a flap 98 shown in FIG. 1 in the top 34 is opened to facilitate cooling by allowing cold air into the system. Flap 98 may also conveniently be located in outlet conduit 82 or associated with inlet port 84. These two measures may be carried out automatically by using sensors, such as electroconductive switches or liquid level probes, to provide a signal when the material being dried rises to a predetermined height in the pan 16. The signal is used to control the burner 48 and flap 98.

When drying and agitating certain materials, balls of material form. Such formation may be prevented by mounting rakes 100, shown in FIG. 3, on the underside of top 34 with teeth 102 that extend downward into pan 16. Agitator paddles 40 will then propel the waste balls against the teeth 102, thereby breaking up such compacted balls.

Although the present invention is described and illustrated with detailed reference to the preferred embodiment, the invention is not intended to be limited to the details of such embodiment, but includes numerous modifications and changes thereto while still falling within the intent and spirit hereof.

We claim:

1. A method for dehydrating waste material comprising the steps of placing the material in a substantially closed vessel and simultaneously:
   agitating the material;
   admitting preheated air to the vessel;
   drawing the air and moisture and gases evolved from the material in the vessel into an incinerator; and
   passing the gases of combustion from the incinerator in proximity to the vessel to heat the material.

2. The method according to claim 1 wherein the step of drawing the air and moisture and gases evolved from the material in the vessel into an incinerator further comprises the step of preheating, mixing and imparting a swirling moisture to the air, moisture and gases.

3. The method according to claim 2 wherein said preheating, mixing and imparting of a swirling motion are accomplished in a labyrinth structure proximate a burner of the incinerator.

4. The method according to claim 1 wherein the step of admitting preheated air to the vessel further comprises preheating the air by passing it through a baffled manifold forming a passage at least partially surrounding the incinerator.

5. A method for dehydrating waste material comprising the steps of placing the material in a substantially closed vessel and simultaneously:
   agitating the material; p1 preheating air by passing it through a baffled manifold forming a passage at least partially surrounding an incinerator and admitting the preheated air to the vessel;
   drawing the air and moisture and gases evolved from the material in the vessel into the incinerator through a labyrinth structure proximate a burner of the incinerator; and
   passing the gases of combustion from the incinerator through a passage proximate the bottom and a portion of the side of the vessel to heat the material.

6. An apparatus for dehydrating waste material comprising:
   (a) a stationary, substantially closed drying pan enclosure for receiving a mass of waste material and having a jacket surrounding the bottom and a portion of the sides thereof;
   (b) a means for agitating the material in the drying pan enclosure;
   (c) an incinerator for preheating air to be admitted to the drying pan enclosure, incinerating combustible gasses drawn from the drying pan enclosure together with the preheated air, and supplying heat to the jacket of the drying pan enclosure to heat the mass of material therein, comprising
      (i) a cylindrical chamber having a burner at one end thereof, and an outlet section at the other end;
      (ii) a labyrinth structure surrounding the burner having an inlet for receiving gasses, and an outlet for exhausting gasses to an area adjacent to the burner; and
      (iii) a baffled manifold surrounding the chamber and having an inlet for receiving air from the atmosphere, and an outlet;
   (d) a fresh air conduit for carrying air from the atmosphere, which has passed through the manifold, to the drying pan enclosure;
   (e) an extraction conduit for carrying gasses from the drying pan enclosure to the inlet of the labyrinth structure of the incinerator;
   (f) a burner exhaust conduit for carrying gasses from the incinerator chamber to the jacket surrounding the drying pan enclosure; and
   (g) a means for moving the air and gasses through the apparatus.

7. The apparatus according to claim 6 wherein
   (a) said drying pan enclosure comprises a first metal cylinder having a vertically oriented axis and closed, planar top and bottom surfaces; and
   (b) said jacket is defined by
      (i) a second metal cylinder oriented coaxially to the first;
      (ii) a closed top surface;
      (iii) a closed planar bottom surface oriented below and parallel to the bottom surface of the first cylinder; and
      (iv) a portion of the outer surface of the first cylinder.

8. The apparatus according to claim 6 wherein said means for agitating the material in said drying pan enclosure comprises a vertical shaft rotatably mounted coaxially with the drying pan enclosure to extend into the interior thereof, having at least one paddle on the lower end thereof and driven by an electric motor.

9. The apparatus according to claim 8 wherein at least one rake is attached to an interior surface of said drying pan enclosure so that the material will be propelled against the rake by said paddle.

10. An apparatus for dehydrating waste material comprising:
   (a) a stationary, substantially closed drying pan enclosure for receiving a mass of waste material comprising:
      (i) a first metal cylinder having a vertically oriented axis and closed, planar top and bottom surfaces; and
      (ii) a jacket surrounding the bottom and a portion of the sides thereof, defined by
         (w) a second metal cylinder oriented coaxially to the first;
         (x) a closed top surface;
         (y) a closed planar bottom surface oriented below and parallel to the bottom surface of the first cylinder; and
         (z) a portion of the outer surface of the first cylinder;

(b) a vertical shaft rotatably mounted coaxially with the drying pan enclosure to extend into the interior thereof for agitating the material in the drying pan enclosure, having at least one paddle on the lower end thereof and driven by an electric motor;

(c) an incinerator for preheating air to be admitted to the drying pan enclosure, incinerating combustible gasses drawn from the drying pan enclosure together with the preheated air, and supplying heat to the jacket of the drying pan enclosure to heat the mass of material therein; and comprising (i) a cylindrical refractory lined chamber having a burner at one end thereof, an outlet section at the other end, and a perforated baffle between the burner and the outlet section;

(ii) a labyrinth structure surrounding the burner comprising coaxially mounted tubes, and having an inlet for receiving gasses and an outlet exhausting gasses to an area adjacent to the burner; and (iii) a manifold surrounding the refractory lined chamber, comprising a jacket surrounding the chamber divided by baffles oriented lengthwise of the incinerator, an inlet for receiving air from the atmosphere, and an outlet;

(d) an fresh air conduit for carrying air from the atmosphere, which has passed through the manifold to the drying pan enclosure;

(e) an extraction conduit for carrying gasses from the drying pan enclosure to the inlet of the labyrinth structure of the incinerator;

(f) a burner exhaust conduit for carrying gasses from the incinerator chamber to the jacket surrounding the drying pan enclosure;

(g) a blower within the extraction conduit for applying suction to the interior of the drying pan enclosure and forcing the gasses therein into the labyrinth structure of the incinerator; and (h) at least one rake attached to an interior surface of the drying pan enclosure so that the material will be propelled against the rake by the paddle.

* * * * *